US011448051B2

(12) United States Patent
Cho et al.

(10) Patent No.: US 11,448,051 B2
(45) Date of Patent: Sep. 20, 2022

(54) MULTILATERAL ACID STIMULATION PROCESS

(71) Applicant: Halliburton Energy Services, Inc., Houston, TX (US)

(72) Inventors: Brian Williams Cho, Katy, TX (US); Benjamin Luke Butler, Conroe, TX (US); Andreas Grossmann, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 649 days.

(21) Appl. No.: 16/342,062

(22) PCT Filed: Mar. 21, 2019

(86) PCT No.: PCT/US2019/023322

§ 371 (c)(1),
(2) Date: Apr. 15, 2019

(87) PCT Pub. No.: WO2019/221818

PCT Pub. Date: Nov. 21, 2019

(65) Prior Publication Data

US 2021/0355803 A1 Nov. 18, 2021

Related U.S. Application Data

(60) Provisional application No. 62/672,359, filed on May 16, 2018.

(51) Int. Cl.
*E21B 43/27* (2006.01)
*E21B 7/06* (2006.01)
(Continued)

(52) U.S. Cl.
CPC ..... *E21B 43/14* (2013.01); *E21B 7/061* (2013.01); *E21B 29/06* (2013.01);
(Continued)

(58) Field of Classification Search
CPC ..... E21B 43/27; E21B 7/061; E21B 34/14; E21B 41/0042; E21B 43/14;
(Continued)

(56) References Cited

U.S. PATENT DOCUMENTS 5,477,923 A * 12/1995 Jordan, Jr. ..... E21B 7/061 166/313
8,490,697 B2 * 7/2013 Garcia ..... E21B 41/0035 166/278
(Continued)

FOREIGN PATENT DOCUMENTS

RU 2459945 C1 8/2012
WO 2017099777 A1 6/2017
WO 2017099780 A1 6/2017

OTHER PUBLICATIONS http://packersplus.com/solution/trex-limited-entry/.
(Continued)

*Primary Examiner* — Michael R Wills, III
(74) *Attorney, Agent, or Firm* — Scott Richardson; Parker Justiss, P.C.

(57) ABSTRACT

A main well bore is drilled. The main well bore is completed and stimulated. The main well bore is sealed. A lateral well bore is drilled off the main well bore. A junction that allows communication with the lateral well bore and that connects the main well bore is inserted. The lateral well bore is stimulated through the junction. The main well bore is unsealed, allowing comingled flow from the main bore and the lateral bore.

13 Claims, 8 Drawing Sheets

(51) Int. Cl.
*E21B 29/06* (2006.01)
*E21B 41/00* (2006.01)
*E21B 43/14* (2006.01)

(52) U.S. Cl.
CPC ..... *E21B 41/0042* (2013.01); *E21B 43/27* (2020.05); *E21B 2200/05* (2020.05); *E21B 2200/06* (2020.05)

(58) Field of Classification Search
CPC .. E21B 2200/05; E21B 2200/06; E21B 29/06; E21B 43/28; E21B 34/00; E21B 34/06; E21B 41/00; E21B 43/25
See application file for complete search history.

(56) References Cited

U.S. PATENT DOCUMENTS 10,196,880 B2 * 2/2019 Steele ..... E21B 33/13
10,352,140 B2 * 7/2019 Parlin ..... E21B 41/0042
2013/0319666 A1 * 12/2013 Nygardsvoll ..... E21B 43/04 166/278
2015/0068756 A1 * 3/2015 Pendleton ..... E21B 41/0035 166/313
2015/0369022 A1 12/2015 Zhou
2016/0341011 A1 11/2016 Steele et al.
2017/0067321 A1 * 3/2017 Parlin ..... E21B 7/061
2017/0130537 A1 5/2017 Parlin
2017/0328177 A1 * 11/2017 Sheehan ..... E21B 7/061
2018/0274300 A1 * 9/2018 Vemuri ..... E21B 7/061
2019/0003258 A1 * 1/2019 Klam ..... E21B 34/14
2019/0186222 A1 * 6/2019 Steele ..... E21B 47/024

OTHER PUBLICATIONS https://www.bhge.com/upstream/completions/multistage-completion-solutions/ball-activated-multistage-fracturing-sleeve-systems/fracpoint-ball.
https://www.halliburton.com/en-US/ps/completions/well-completions/horizontal-completions/frac-sleeve-systems.html.
https://www.tervesinc.com/frac-balls/.
Jason Baihly, SPE, Isaac Aviles, SPE, Joshua Johnson and George Melenyzer, Schlumberger, Sleeve Activation Sleeve Activation in Open-hole Fracturing Systems: A Ball Selection Study, SPE 162657, Society of Petroleum Engineers, 2012 SPE Canadian Unconventional Resources Conference, Oct. 30-Nov. 1, 2012, pp. 1-14, Calgary, Alberta Canada.
Schlumberger, Falcon, Multistage stimulation system, slb.com/mss.

* cited by examiner

MULTILATERAL ACID STIMULATION PROCESS

BACKGROUND

It is common in the production of hydrocarbons from the earth to drill multilateral wells, i.e., a well with a main bore and one or more laterals that branch off the main bore. Performing acid stimulation without "intervention", which is defined to be without the need to make extra round trips in and out of the well with downhole service tools on wireline, slickline or coiltubing during the process of performing the acid stimulation, in a multilateral well environment is a challenge.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

A process for acid stimulation in a multilateral environment is disclosed.

Figure 1:
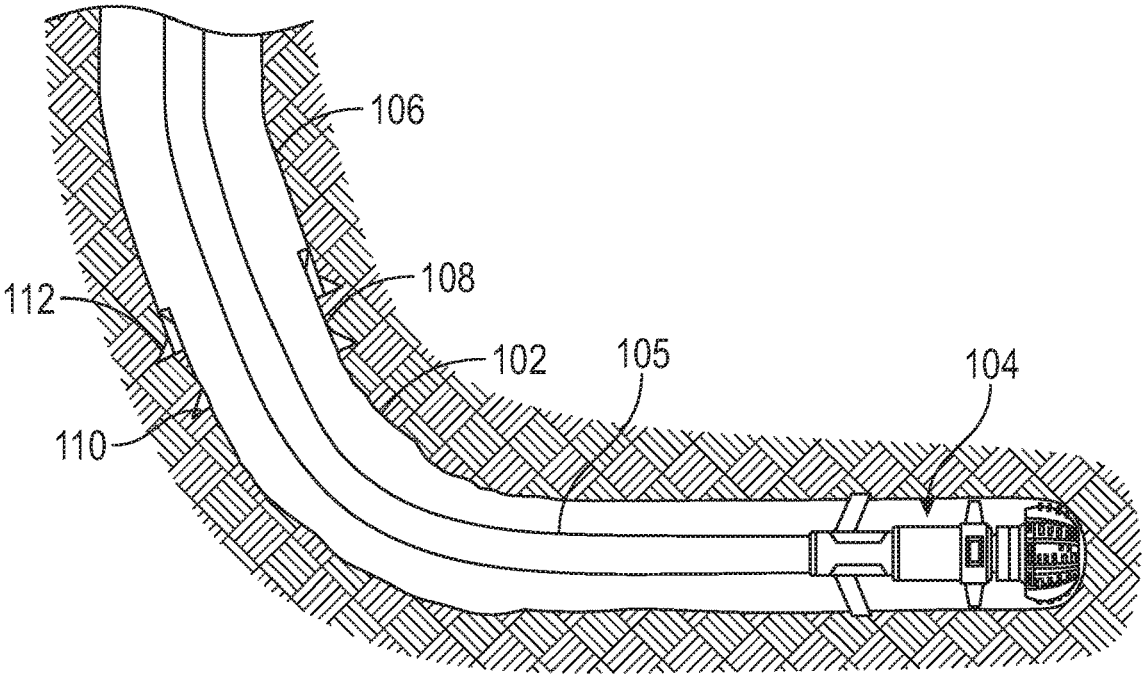
FIG. 1 is a schematic of a well bore drilled for a multilateral liner.

FIG. 1 is a schematic of a well bore drilled for a multilateral liner. A main well bore 102 may be drilled, for example by a rotary steerable system 104 at the end of a drill string 105 as shown in FIG. 1 and may extend from a well origin (not shown), such as the earth's surface or a sea bottom. The main well bore 102 may be lined by one or more casings 106, 108, each of which is terminated by a shoe 110, 112.

Figure 2:
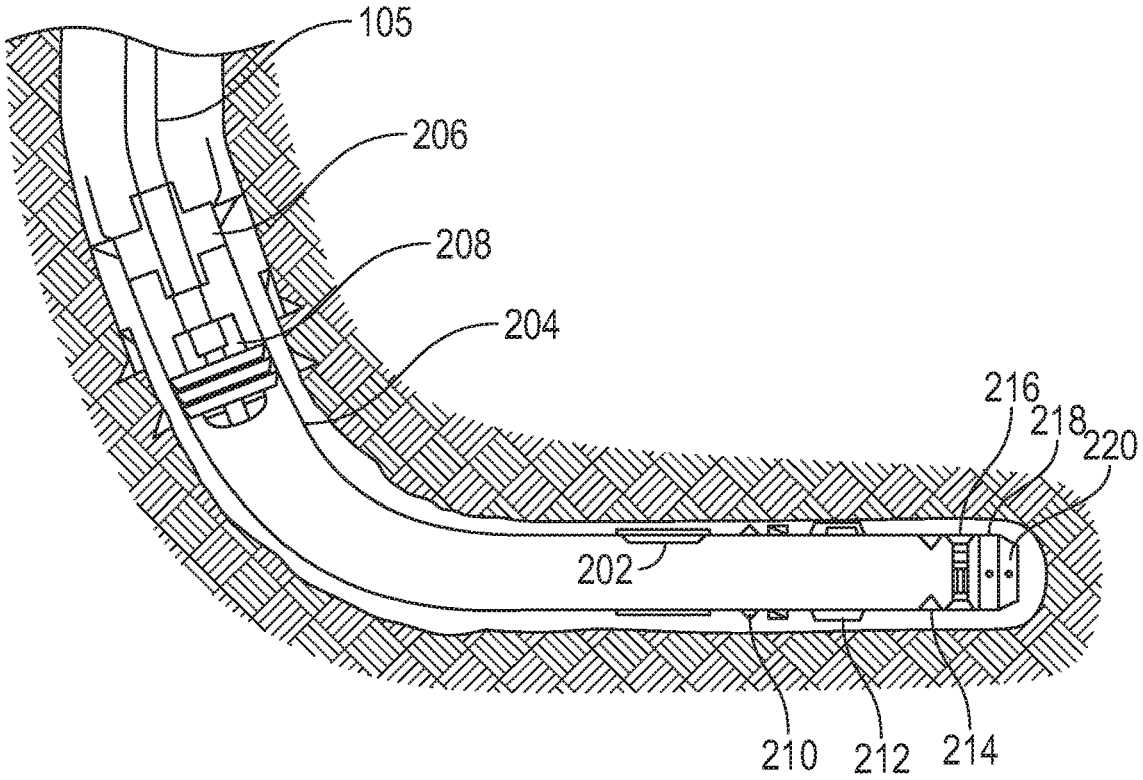
FIG. 2 is a schematic of the well bore with a casing string, a pre-milled window, and a casing orientation tool installed.

FIG. 2 is a schematic of the well bore with a casing string, a pre-milled window, and a casing orientation tool installed. A pre-milled window 202, or equivalent, may be installed as integral part of the casing string. The pre-milled window 202 may be made up as a standard casing joint 204 and run in hole to depth. A liner hanger 206 and wiper set 208 may be run in using the drill string 105. The standard casing joint 204 may include a latch coupling 210, a casing orienting tool (COT), or equivalent, 212, a landing collar 214, a pressure drop sub 216, a float collar 218, and a float shoe 220. Once on depth, flow through the COT 212, or equivalent, may provide the orientation of the pre-milled window 202.

Figure 3:
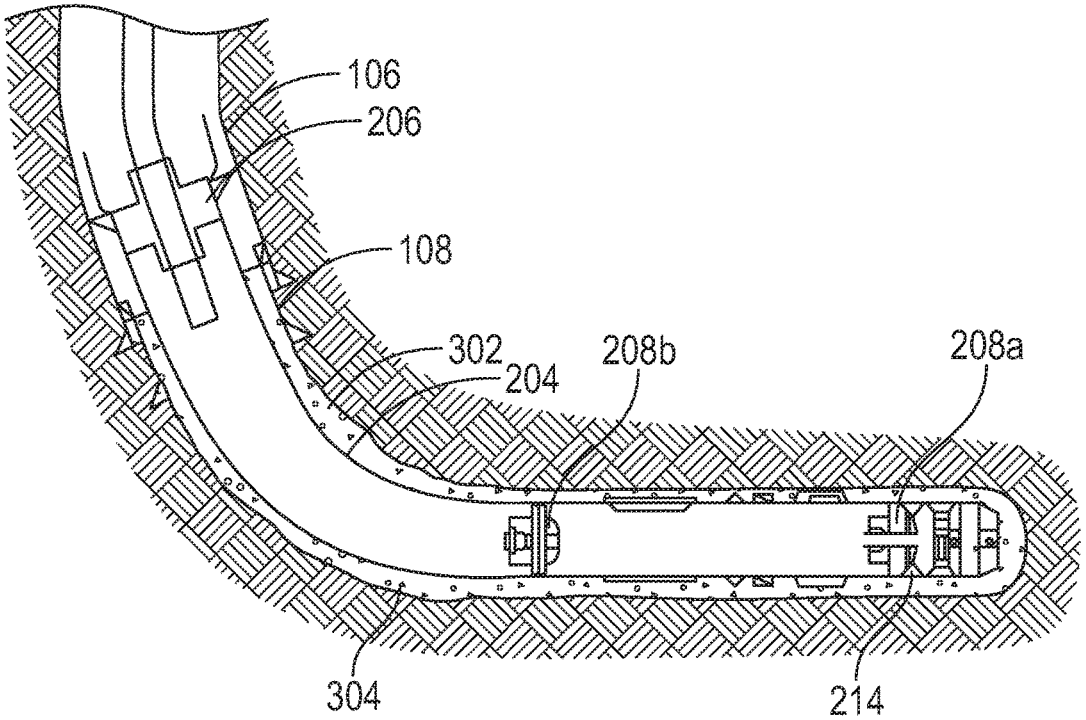
FIG. 3 is a schematic of the well bore after the casing string is cemented.

FIG. 3 is a schematic of the well bore after the casing string is cemented. The pre-milled window 202 may be oriented and the casing string 106, 108, 204 may be cemented, as shown in FIG. 3. At this point the wiper set 208 has been separated into a bottom dart 208*a*, which is seated against the landing collar 214, and a top wiper with a displacing dart 208*b*, which is displacing the cement 302 from inside the standard casing joint 204 into an annulus 304 outside the standard casing joint 204. Alternatively, a standard measurement while drilling (MWD) technique may be used to orient the pre-milled window.

Figure 4:
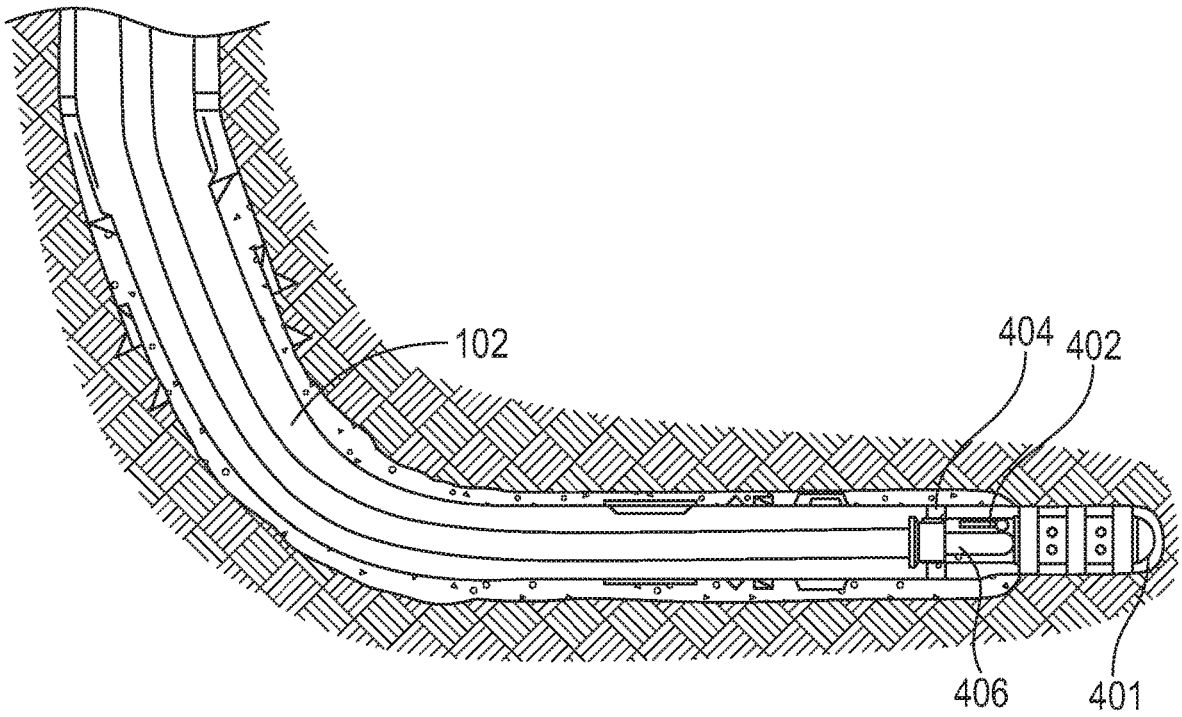
FIG. 4 is a schematic of a well bore after it has been drilled out.

FIG. 4 is a schematic of a well bore after it has been drilled out. The casing string 106, 108, 204 is drilled out and main bore completions 401 are run into the main well bore 102. A fluid loss device (flapper valve) 402 may be installed on top of the main bore completion. A packer running tool 404 may keep the flapper valve 402 open. The packer may be set and released from the packer running tool 404. A service tool washpipe 406 keeps the flapper valve 402 open while the main bore completion zones are stimulated (using the same techniques as used in lateral stimulation, discussed below). After stimulation the flapper valve 402 may be closed, isolating the main bore completion during multilateral well construction.

Figure 5:
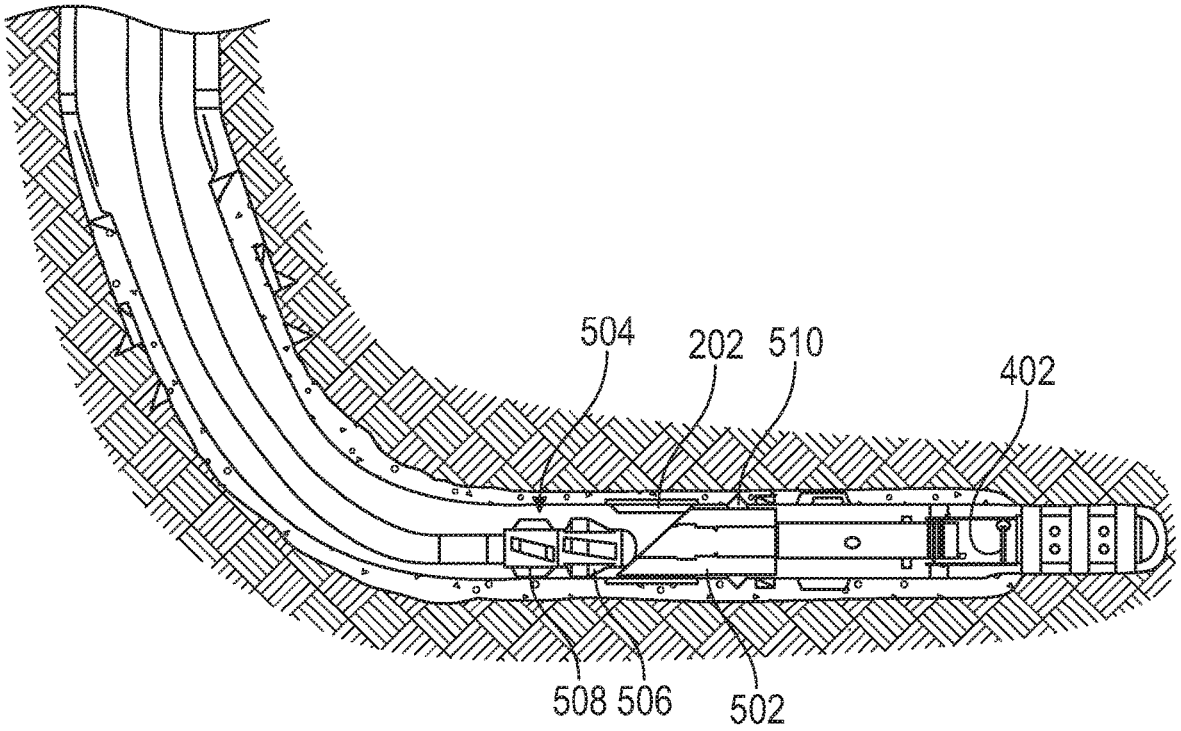
FIG. 5 is a schematic of a well bore with a whipstock and shear-bolted mill assembly installed.

FIG. 5 is a schematic of a well bore with a whipstock and shear-bolted mill assembly installed. A whipstock 502 and shear-bolted mill assembly 504, including a lead mill 506 and a watermelon mill 508, may be run in hole and installed in a selected latch coupling 510 below the pre-milled window 202. The flapper valve 402 is closed.

Figure 6:
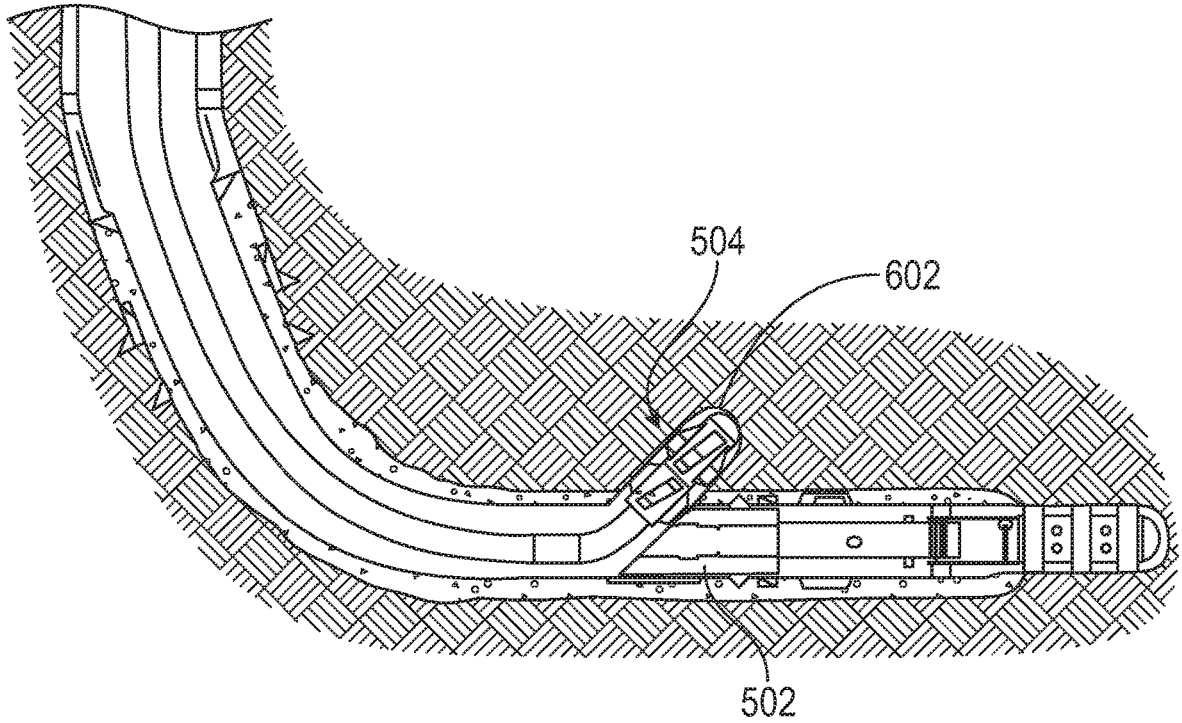
FIG. 6 is a schematic of a well bore after a window is milled.

FIG. 6 is a schematic of a well bore after a window is milled. The mill assembly 504 may be sheared free from the whipstock 502 and the window may be milled. Two to five meters of formation may be drilled to act as a pilot hole 602 for a directional drilling bottom hole assembly (BHA). The mill assembly 504 may be pulled out of hole (POOH) following the milling operation.

Figure 7:
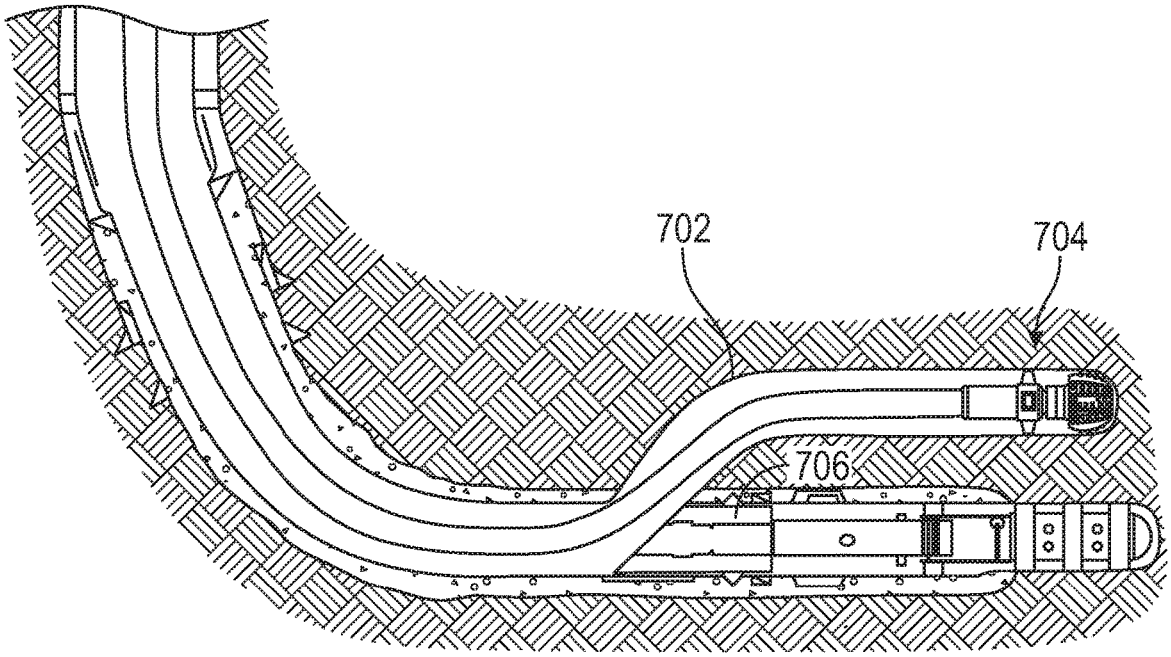
FIG. 7 is a schematic of a well bore as a lateral is being drilled.

FIG. 7 is a schematic of a well bore as a lateral is being drilled. The lateral 702 may be drilled with a standard directional drilling BHA 704. The window allows for drill bits up to casing drift to pass through.

Figure 8:
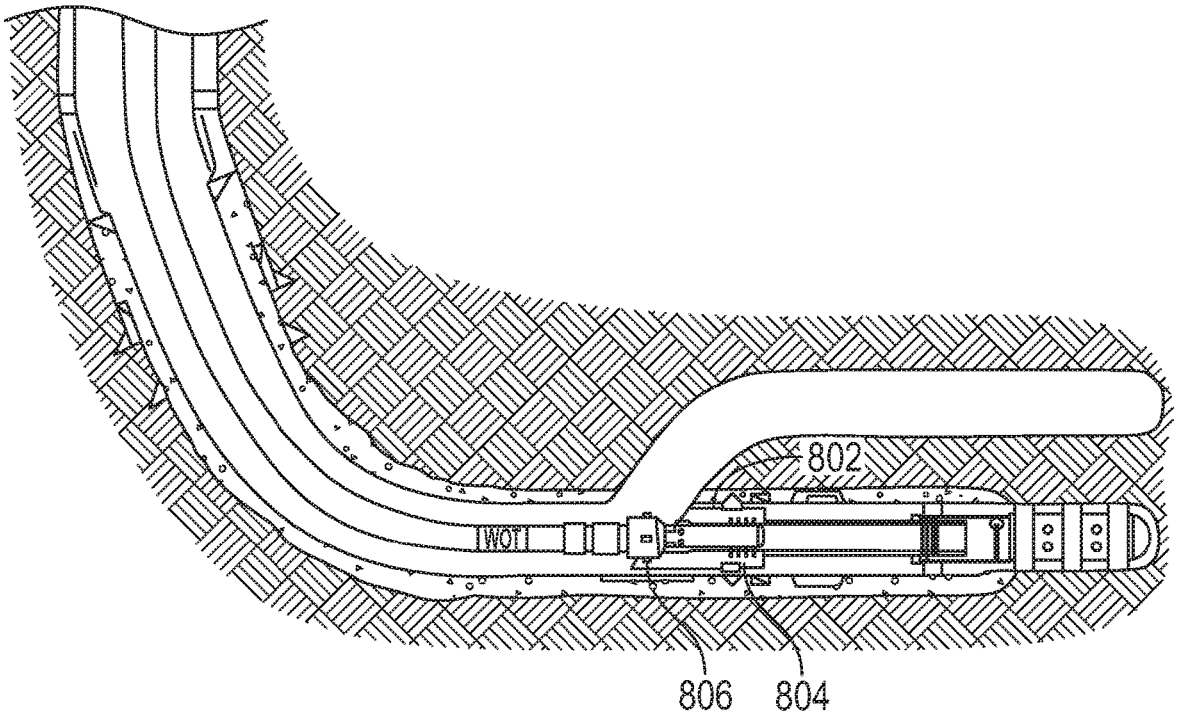
FIG. 8 is a schematic of a multilateral well bore after the whipstock is removed and a completions deflector is installed.

FIG. 8 is a schematic of a multilateral well bore after the whipstock is removed and a completions deflector is installed. The drilling deflector 706 (shown in FIG. 7) is replaced with a completion deflector 802 in preparation for junction and lateral completion run. The completions deflector 802 diverts the lateral completion in the lateral and provides for a main bore stinger seal 804 using, for example, a hydro-mechanical run tool 806.

Figure 9:
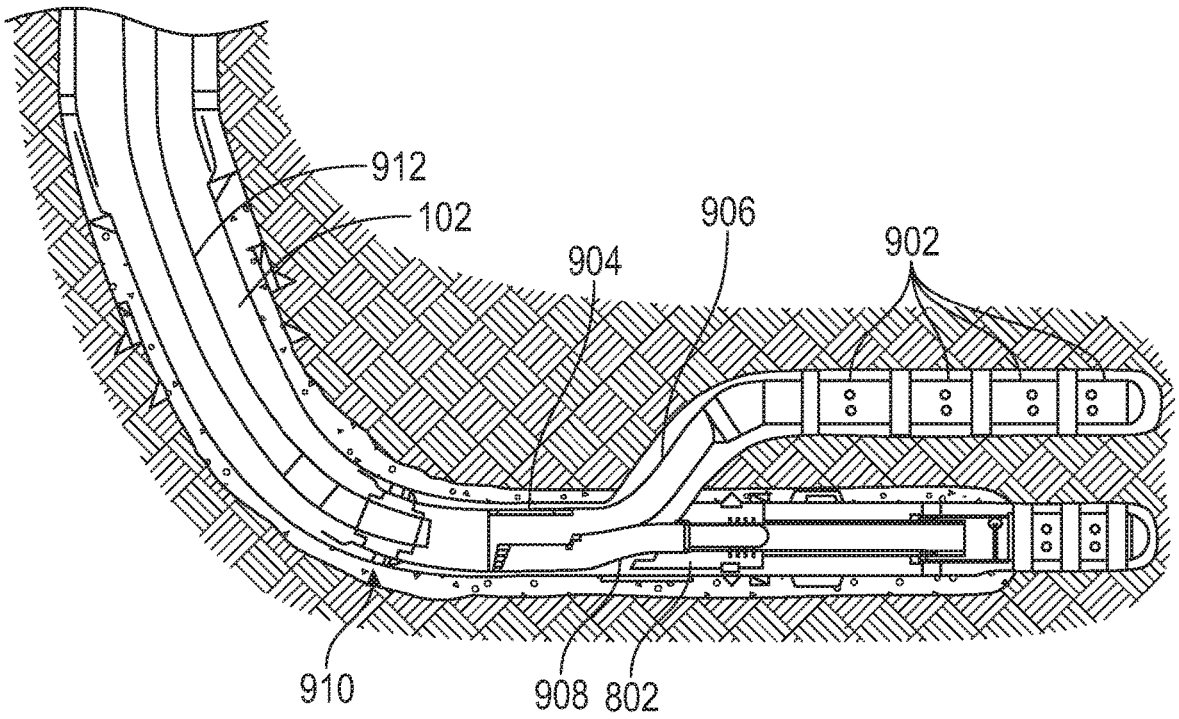
FIG. 9 is a schematic of a multilateral well bore after the lateral completions are run in below a junction.

FIG. 9 is a schematic of a multilateral well bore after the lateral completions are run in below a junction. The lateral completions 902 and the junction 904 may be landed on one trip. The long leg 906 of the junction 904 may be deflected out into the lateral and short leg 908 may be oriented and land inside an inverted seal assembly inside the completions deflector 802. A liner hanger or packer 910 may be set in the main well bore 102 to create junction pressure integrity forming a level 5 junction. Production tubing 912 carries fluids to the well origin.

Figure 10:
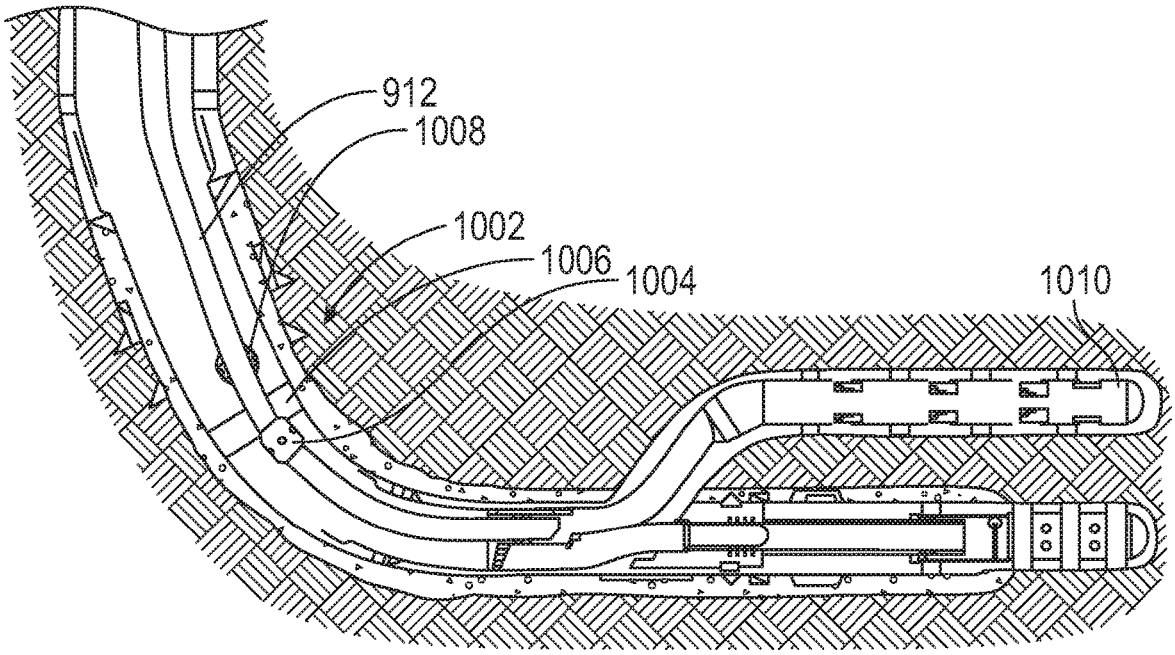
FIG. 10 is a schematic of a multilateral well bore with an example of an upper completion being run.

FIG. 10 is a schematic of a multilateral well bore with an example of an upper completion being run. For a dual lateral, the upper completion 1002, including, for example, a perforated sub with a sliding sleeve 1004, a production packer 1006, a Chemical Injection Valve and Gas Lift Valve 1008, and a toe sub 1010, may be installed, as shown in FIG. 10, and the rig (not shown) may be moved off location if applicable. For stacked multiple laterals a stimulation workstring may be used instead.

Figure 11:
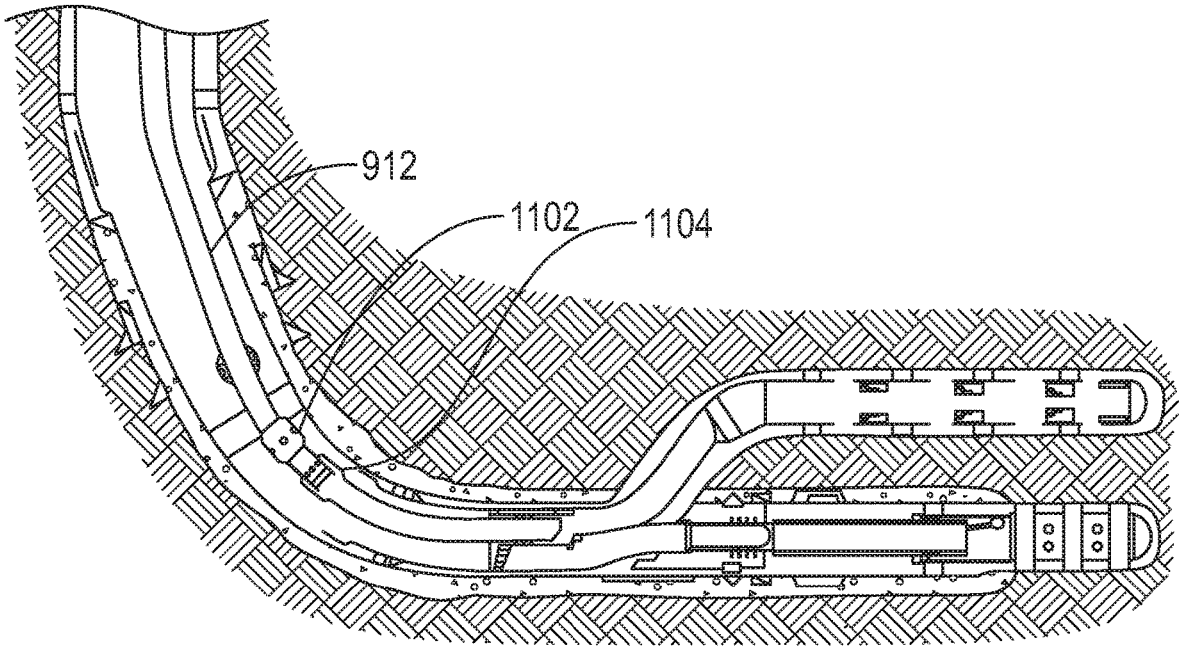
FIG. 11 is a schematic of a multilateral well bore with an example of an upper completion using a smart completion.

FIG. 11 is a schematic of a multilateral well bore with an example of an upper completion using a smart completion. This is an alternate embodiment of the upper completion shown in FIG. 10. Alternatively, the upper completion could be a smart completion using Intelligent Control Valves (ICVs), such as ICV 1102 or shrouded ICV 1104.

Figure 12:
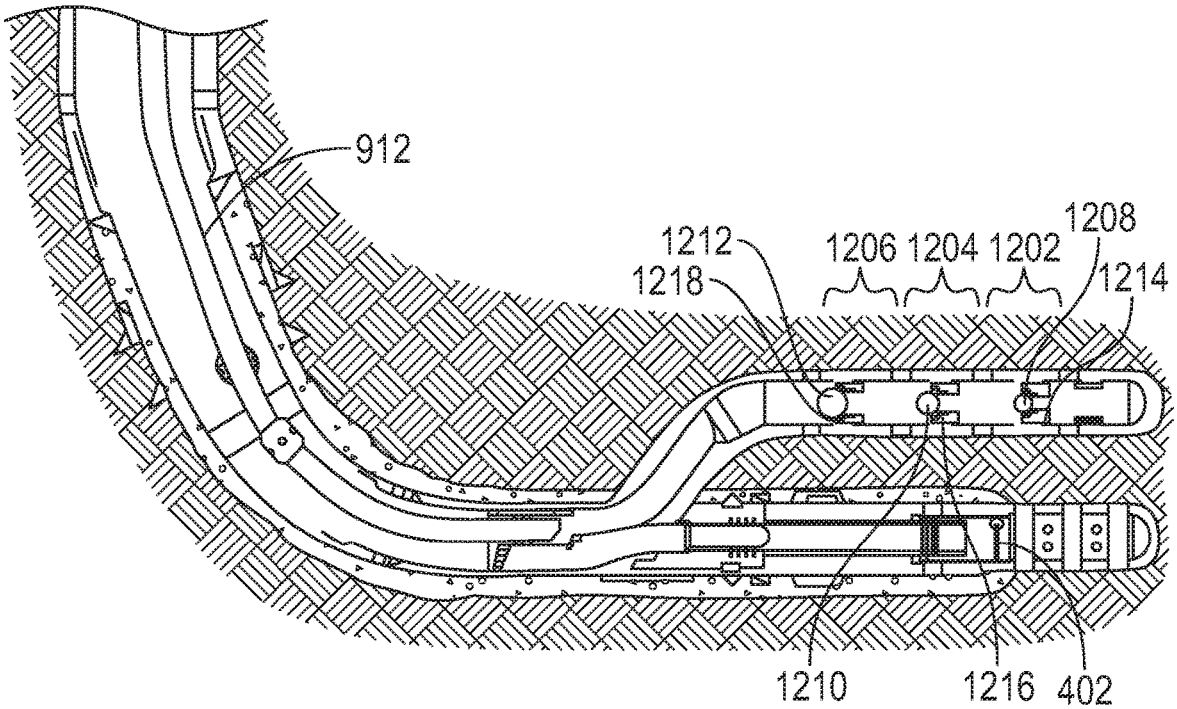
FIG. 12 is a schematic of a multilateral well bore showing a lateral completion zone being stimulated.
Figure 13:
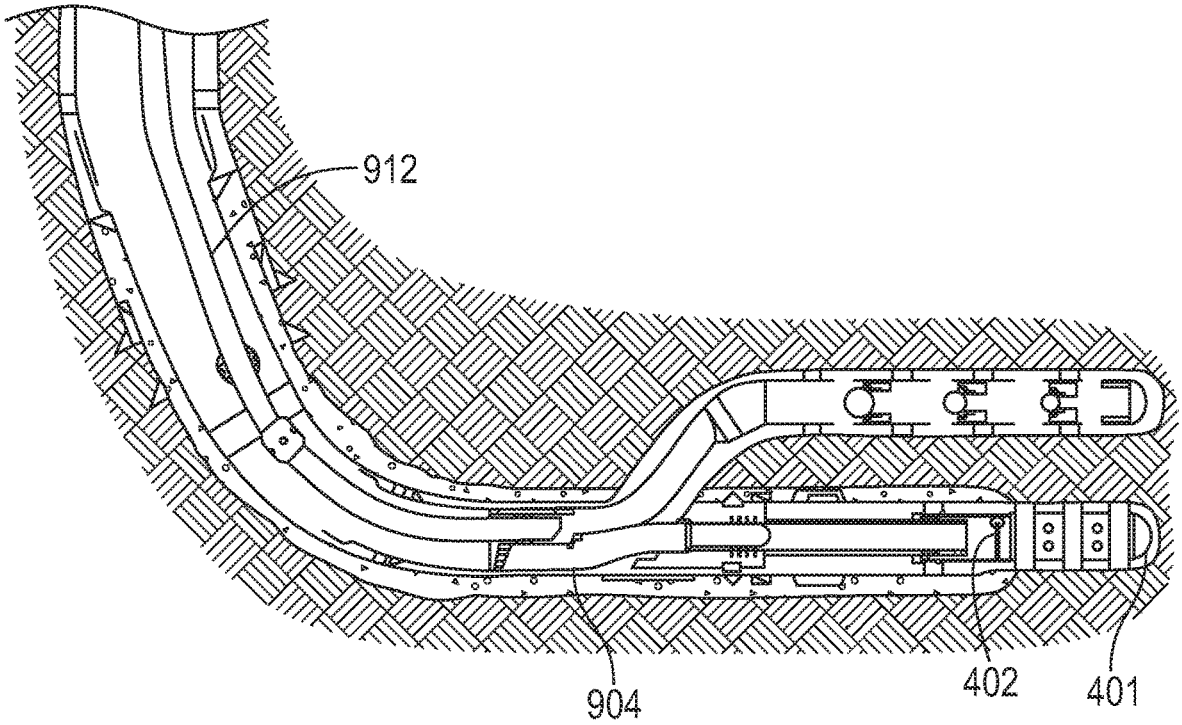
FIG. 13 is a schematic of a multilateral well bore after the lateral completion zones have been stimulated.

FIG. 12 is a schematic of a multilateral well bore showing a lateral completion zone being stimulated. FIG. 13 is a schematic of a multilateral well bore after the lateral completion zones have been stimulated.

Lateral completion may be set up as compartmental zones 1202, 1204, 1206, as shown in FIG. 12. Each compartment 1202, 1204, 1206 may be configured using various multistage stimulation system of tools to stimulate each zone separately. The most common ball drop system is described below. The dissolvable graduated ball drop method illustrated in FIG. 12 is merely an example. All other frac sleeve methods may be used. The well bore may be pressured up to activate the toe sub 1010 sleeve. The smallest ball 1208 may then be dropped to open the bottom-most valve. Acid stimulation may then be pumped. The next sized ball (1210 and 1212, in turn) may then be dropped and the process repeated until all the lateral completion zones have been stimulated, as shown in FIG. 13. Note that in FIG. 13 the balls 1208, 1210, and 1212 and the respective equipment 1214, 1216, 1218 to receive them, have moved in sequence to open respective zones 1202, 1204, 1206 for stimulation. No intervention is required because the junction 904 and the sealed mainbore completions 401 (sealed by the fluid loss device 402) automatically direct objects and the acid stimulation fluids to the lateral. Multiple lateral legs may be stacked using the same technique/method.

Figure 14:
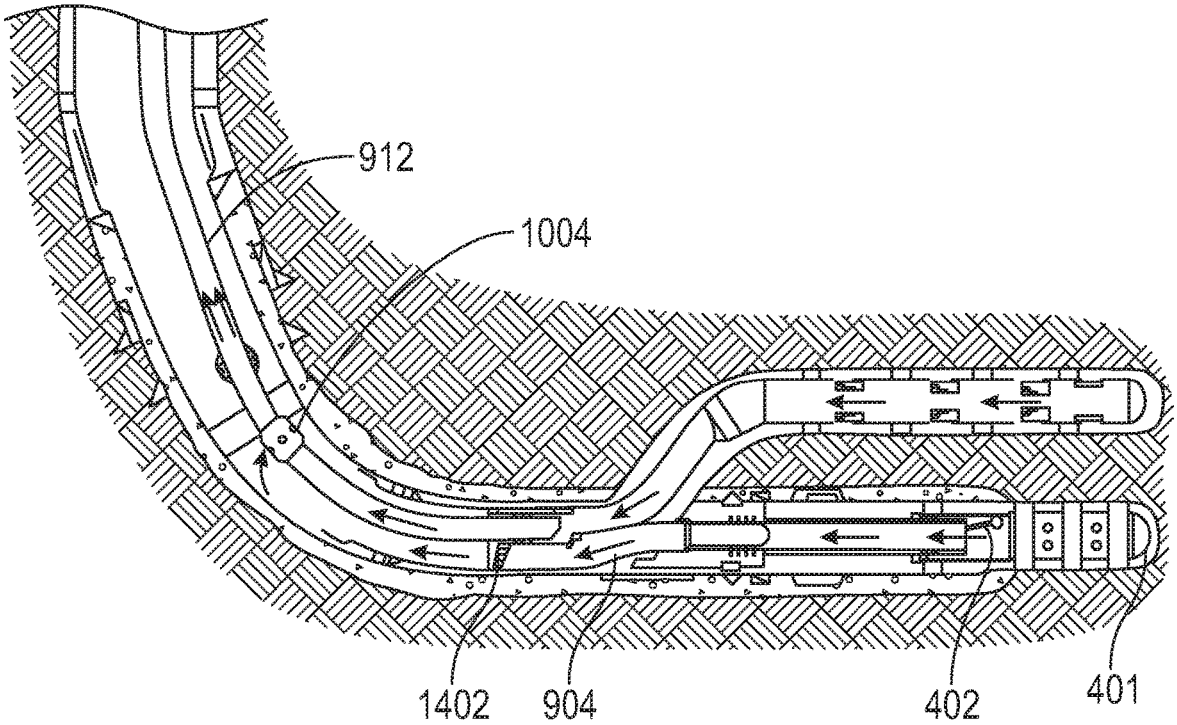
FIG. 14 is a schematic of a multilateral well bore with comingled flow paths.
Figure 15:
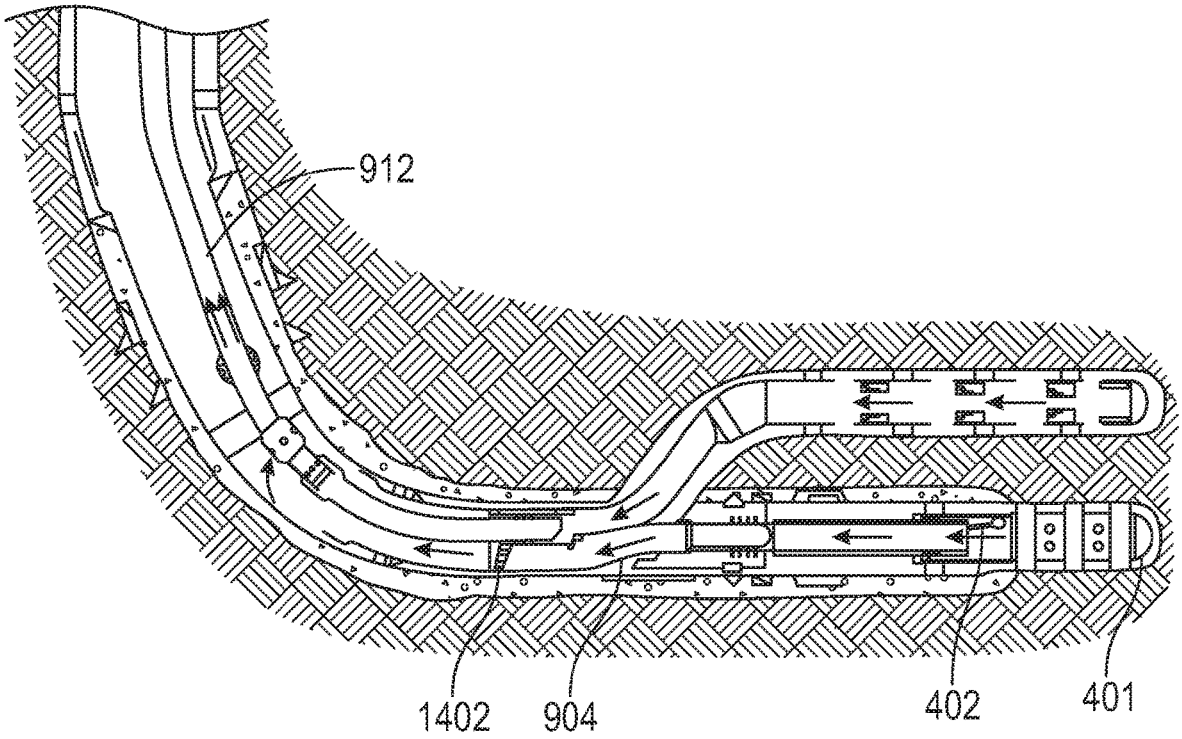
FIG. 15 is a schematic of a multilateral well bore using intelligent completions with comingled flow paths.

FIG. 14 is a schematic of a multilateral well bore with comingled flow paths. FIG. 15 is a schematic of a multilateral well bore using intelligent completions with comingled flow paths.

After the stimulation, the overall completion may set up for commingled flow from the dual lateral well bores, as shown in FIGS. 14 and 15. The lower fluid loss device 402 may flap up to allow production from the main bore completion 401. The flow may come through a fluted area 1402 of the junction 904 and into the tubing through the perforated sub or a sliding sleeve. Alternatively, the fluid loss device 402 may be replaced with a remotely actuated valve.

Clause 1. A method for acid stimulation of a multilateral well, comprising:

drilling a main well bore;

completing and stimulating the main well bore;

sealing the main well bore;

drilling a lateral well bore off the main well bore;

inserting a junction that allows mechanical access and hydraulic communication with the lateral well bore and that allows communication with the main well bore;

stimulating the lateral well bore without intervention; and unsealing the main well bore, allowing comingled flow from the main well bore and the lateral well bore.

Clause 2. The method of any preceding clause wherein sealing the main well bore so that only flow in the up direction is allowed includes:

installing a main bore completion; and installing a fluid loss device above the main bore completion, wherein the fluid loss device has an open position, in which fluid is allowed to flow therethrough, and a closed position in which fluid flow is not allowed, and wherein the fluid loss device is installed above the main bore completion in the closed position.

Clause 3. The method of any preceding clause wherein unsealing the main well bore includes transitioning the fluid loss device from the closed position to the open position.

Clause 4. The method of any preceding clause wherein the fluid control device includes a flapper valve.

Clause 5. The method of any of clauses 1-3 wherein the fluid control device includes a remotely actuated valve.

Clause 6. The method of any preceding clause wherein stimulating the lateral well bore without intervention includes stimulating the lateral well bore through the junction while the mail well bore is still sealed.

Clause 7. A system for producing hydrocarbons from a multilateral well, comprising:

a main well bore extending from a well origin;

a lateral well bore branching from the main well bore;

a main bore completion positioned in a main well bore producing zone in the main well bore;

a lateral completion installed in a lateral producing zone in the lateral well bore;

a junction having:

a first leg positioned in the lateral well bore between the well origin and the lateral completion, a second leg positioned in the main well bore between the well origin and the main bore completion, and a coupling where the first leg and the second leg are mechanically joined a fluid loss device positioned between the main bore completion and the junction, wherein the fluid loss device has an open position, in which fluid is allowed to flow therethrough, and a closed position in which fluid flow is not allowed, and wherein the fluid loss device is actuatable from the closed position to the open position.

Clause 8. The system of clause 7 wherein the lateral bore is stimulatable without intervention.

Clause 9. The system of clause 8 wherein stimulating the lateral bore without intervention includes stimulating the lateral well bore through the junction while the fluid loss device is in the closed position.

Clause 10. The system of any preceding clause wherein comingled production from the lateral well bore and the main well bore occurs when the fluid loss device is in the open position.

Clause 11. The system of any of clauses 7-10 further comprising:

production tubing coupled to the lateral well bore and, when the fluid loss device is in the open position, to the main well bore.

Clause 12. The system of any of clauses 7-11 further comprising:

production tubing;

a valve coupled on one side to the production tubing and on the other side to the lateral well bore;

the valve coupled to the main well bore;

wherein in a comingled-production position, the valve comingles production from the main well bore and from the lateral well bore; and in a lateral-only position, the valve passes production from the lateral well bore but not from the main well bore.

Clause 13. The system of clause 12 wherein the valve includes a perforated sub with a sliding sleeve.

Clause 14. The system of any of clauses 12 or 13 wherein the valve includes an interval control valve.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method for acid stimulation of a multilateral well, comprising:

drilling a main well bore;

completing and stimulating the main well bore;

sealing the completed and stimulated main well bore;

drilling a lateral well bore off the sealed completed and stimulated main well bore;

inserting a junction that allows mechanical access and hydraulic communication with the lateral well bore and that allows communication with the main well bore;

stimulating the lateral well bore without intervention; and unsealing the main well bore, allowing comingled flow from the main well bore and the lateral well bore.

2. The method of claim 1 wherein sealing the main well bore so that only flow in the up direction is allowed includes:

installing a main bore completion; and installing a fluid loss device above the main bore completion, wherein the fluid loss device has an open position, in which fluid is allowed to flow therethrough, and a closed position in which fluid flow is not allowed, and wherein the fluid loss device is installed above the main bore completion in the closed position.

3. The method of claim 2 wherein unsealing the main well bore includes transitioning the fluid loss device from the closed position to the open position.

4. The method of claim 2 wherein the fluid loss device includes a flapper valve.

5. The method of claim 2 wherein the fluid loss device includes a remotely actuated valve.

6. The method of claim 1 wherein stimulating the lateral well bore without intervention includes stimulating the lateral well bore through the junction while the main well bore is still sealed.

7. A system for producing hydrocarbons from a multilateral well, comprising:

a main well bore extending from a well origin;

a lateral well bore branching from the main well bore, wherein the lateral bore is stimulatable without intervention;

a main bore completion positioned in a main well bore producing zone in the main well bore;

a lateral completion installed in a lateral producing zone in the lateral well bore;

a junction having:

a first leg positioned in the lateral well bore between the well origin and the lateral completion, a second leg positioned in the main well bore between the well origin and the main bore completion, and a coupling where the first leg and the second leg are mechanically joined a fluid loss device positioned between the main bore completion and the junction, wherein the fluid loss device has an open position, in which fluid is allowed to flow therethrough, and a closed position in which fluid flow is not allowed, and wherein the fluid loss device is actuatable from the closed position to the open position.

8. The system of claim 7 wherein stimulating the lateral bore without intervention includes stimulating the lateral well bore through the junction while the fluid loss device is in the closed position.

9. The system of claim 7 wherein comingled production from the lateral well bore and the main well bore occurs when the fluid loss device is in the open position.

10. The system of claim 7 further comprising:

production tubing coupled to the lateral well bore and, when the fluid loss device is in the open position, to the main well bore.

11. The system of claim 7 further comprising:

production tubing;

a valve coupled on one side to the production tubing and on the other side to the lateral well bore;

the valve coupled to the main well bore;

wherein in a comingled-production position, the valve comingles production from the main well bore and from the lateral well bore; and in a lateral-only position, the valve passes production from the lateral well bore but not from the main well bore.

12. The system of claim 11 wherein the valve includes a perforated sub with a sliding sleeve.

13. The system of claim 11 wherein the valve includes an interval control valve.

* * * * *